US005928019A

United States Patent [19]

Chen et al.

[11] Patent Number: 5,928,019

[45] Date of Patent: Jul. 27, 1999

[54] SAFETY SOCKET

[76] Inventors: Chih-Ching Chen, 3F., No. 22, Lane 165, Yan Jyi Street, Tuu Cherng City, Taipei Hsien, Taiwan; Yu-Lung Hsiang, No. 10, Yeong An Street, Yeong Her City, Taipei Hsien, Taiwan; Liang-Jung Liu, 3F., No. 2, Alley 2, Lane 252, Sec. 4, Shin Hay Rd., Taipei, Taiwan

[21] Appl. No.: 08/995,096

[22] Filed: Dec. 19, 1997

[51] Int. Cl.[6] ..... H01R 29/00

[52] U.S. Cl. ..... 439/188; 200/51.09

[58] Field of Search ..... 200/51.09, 51.1; 439/188, 259, 261

[56] References Cited

U.S. PATENT DOCUMENTS

| | | | |
|---|---|---|---|
| 3,701,074 | 10/1972 | Oster | 439/188 |
| 4,179,180 | 12/1979 | Hanna | 439/337 X |
| 5,551,884 | 9/1996 | Burkhart, Sr. | 439/188 X |
| 5,725,388 | 3/1998 | Huang | 439/188 |

*Primary Examiner*—Khiem Nguyen

*Attorney, Agent, or Firm*—Pro-Techtor International Services

[57] ABSTRACT

A safety socket for avoiding danger of shock due to insertion of alien article into the insertion hole. The socket includes two high and two low fixing seats. Two insulative slide boards are reversely disposed on the fixing seats side by side. The lower edge of each slide board is disposed with an elliptic slot for a pin member to pass therethrough, whereby the slide boards can be limitedly left and right slided. The socket further includes two long and two short leaf springs. The short leaf springs abut against front edges of the slide boards. The long leaf springs are fixed on inner walls of a housing of the socket opposite to the short leaf springs. The long and short leaf springs are disposed with convex contact points opposite to each other. When a plug is not inserted into the socket, the slide boards are pushed by the resilient force of the short leaf springs to the center of the socket away from the long leaf springs so as to open the circuit. While when the plug is inserted into the socket, the contact points of the long and short leaf springs contact with each other to close the circuit.

2 Claims, 3 Drawing Sheets

SAFETY SOCKET

BACKGROUND OF THE INVENTION

The present invention relates to a safety socket for avoiding danger of shock due to insertion of alien article into the insertion hole.

A domestic socket is mounted on a wall for a plug to insert thereinto (including 220 V three hole type socket and 110 V two hole type socket ). The internal structure of the socket includes two adjacent conductive leaf springs disposed in each insertion hole. The insertion plate of the plug is inserted into the space between the leaf springs to achieve electric connection. According to such arrangement, in case a conductive alien article such as an iron wire or an iron plate is inserted into any of the insertion holes by an innocent person such as a child, the person may be shocked and injured. Therefore, the conventional socket lacks any safety design for avoiding the danger of shock.

SUMMARY OF THE INVENTION

It is therefore a primary object of the present invention to provide a safety socket for avoiding danger of shock due to insertion of alien article into the insertion hole so as to ensure safety. The safety socket of the present invention includes two high and two low fixing seats. Two insulative slide boards are left and right slidably disposed on the fixing seats. The slide boards are substantially shaped as a right triangle for controlling whether the insertion hole on the other side is electrically connected with the power. The socket further includes two long and two short leaf springs respectively fixedly in the insertion holes of the socket. The short leaf springs abut against front edges of the slide boards and are movable along with the slide boards. The long leaf springs are fixedly disposed on inner side of the socket. The long and short leaf springs are disposed with convex contact points opposite to each other. When a plug is not inserted into the socket, the slide boards are pushed by the resilient force of the short leaf springs to the center of the socket away from the long leaf springs so as to open the circuit. While when the plug is inserted into the socket, the contact points of the long and short leaf springs contact with each other to close the circuit. In case a conductive alien article is inserted into one insertion hole on one side, the alien article will only push the slide board on one side to electrically connect the insertion hole on the other side with the power, while the insertion hole on this side is not electrically connected with the power to avoid danger of shock.

The present invention can be best understood through the following description and accompanying drawings, wherein:

DETAILED DESCRIPTION OF THE PREFERRED EMBODIMENT

Figure 1:
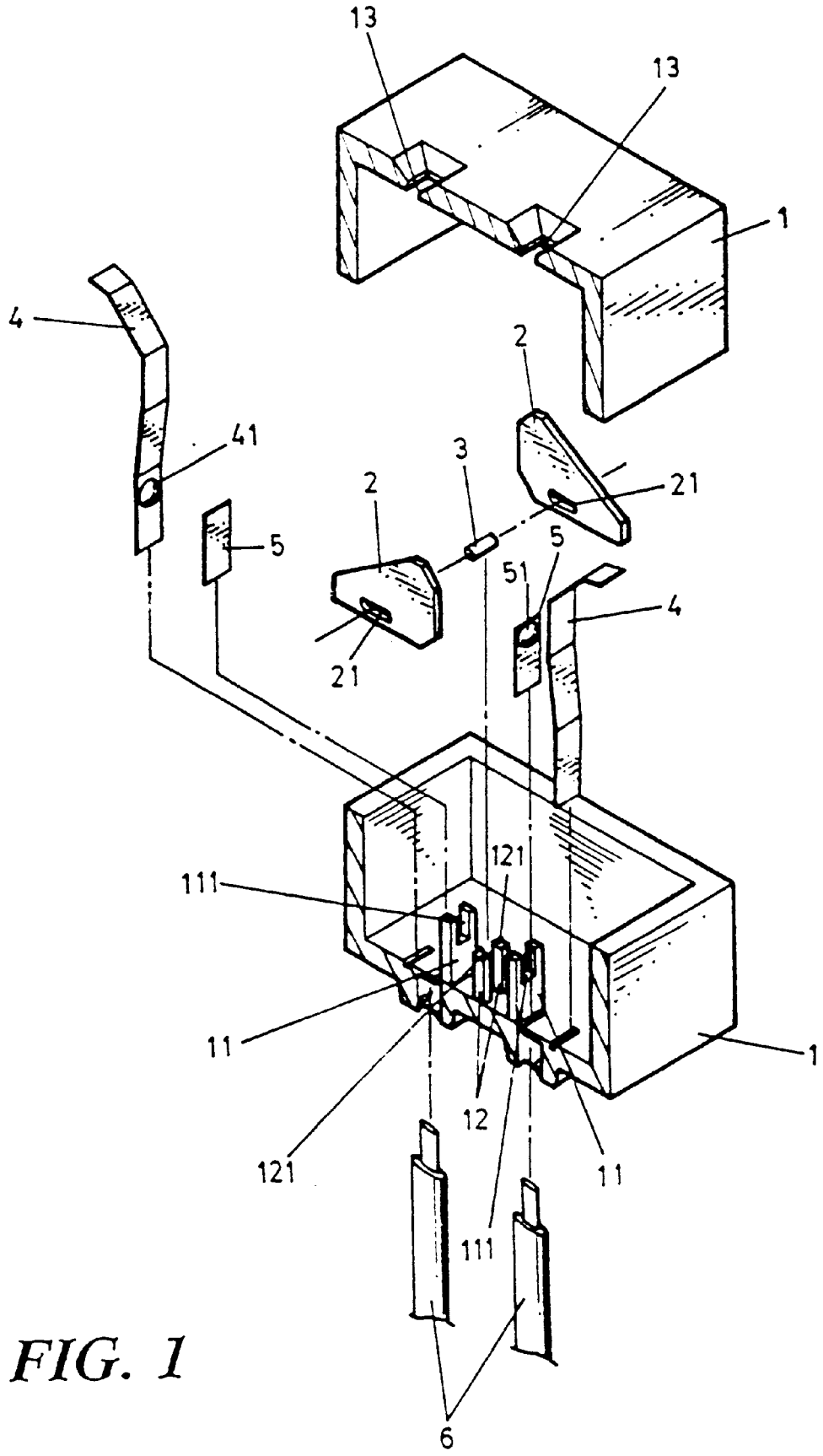
FIG. 1 is a perspective exploded view of the present invention.

Please refer to FIG. 1. The safety socket 1 of the present invention includes a fixing seat set composed of two high fixing seats 11 and two low fixing seats 12. The high fixing seats 11 are disposed on two sides of the low fixing seats 12. Each high fixing seat 11 is formed with a U-shaped recess 111 for receiving two slide boards 2. The low fixing seats 12 are disposed between the high fixing seats 11 side by side opposite to the slide boards 2. The top end of each low fixing seat is formed with a semicircular notch 121, whereby a pin member 3 is transversely positioned in the notch. The slide board 2 is made of insulative material and substantially shaped as a right triangle. Each angle of the slide board 2 is cut off or formed as a round angle. The two slide boards 2 are oppositely and reversely placed in the U-shaped recesses 111 side by side. The lower edge of the slide board 2 is disposed with an elliptic slot 21 for the pin member 3 to pass therethrough. When the slide boards 2 and the pin member 3 are fixed on the high and low fixing seats 11, 12, the pin member 3 is restricted within the slots 21, whereby the slide boards 2 are limitedly left and right slidable.

Two long and two short leaf springs 4, 5 are respectively fixedly and movably inserted into two sides of the interior of the socket 1 corresponding to the insertion holes 13 of the socket 1. The short leaf springs 5 are curved with back sides abutting against the front edges of the slide boards 2. In a not forced state, the resilient force of the short leaf springs pushes the slide boards 2 to the other side opposite to the long leaf springs 4. The bottom ends of the short leaf springs 5 are inserted and fixed in the base of the socket 1 and are movably, stretchably and electrically connected with the power wire 6. The long leaf springs 4 are fixed on inner walls of the housing of the socket 1. One side of each of the opposite long and short leaf springs is disposed with a convex contact point 41, 51. When the contact points 41, 51 contact with each other, the circuit is closed. The slide board 2 in the insertion hole 13 on one side will be slided by external force to control whether the long and short leaf springs 4, 5 in the insertion hole 13 on the other side contact with each other. Therefore, in the case that an alien article is inserted into only one insertion hole, this insertion hole is not electrically connected with the power, while the other insertion hole 13 is electrically connected.

Figure 2:
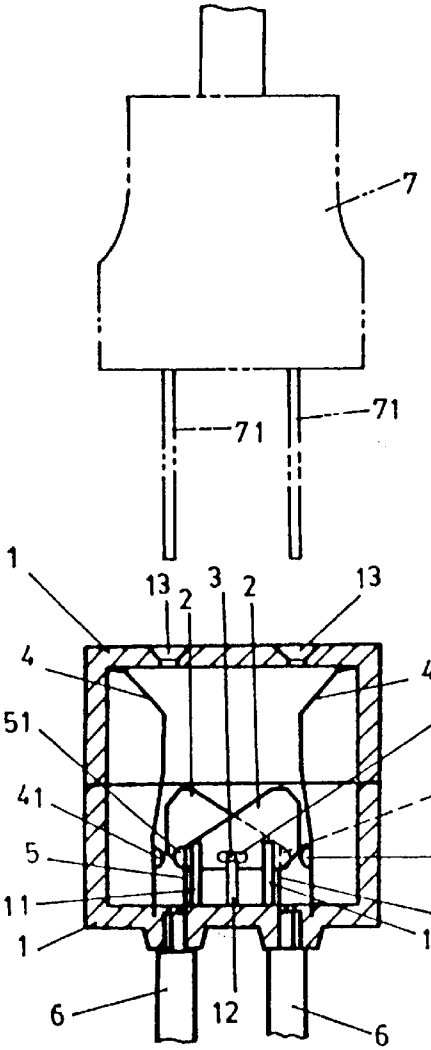
FIG. 2 is a sectional view showing that a plug is to be inserted into the socket.
Figure 3:
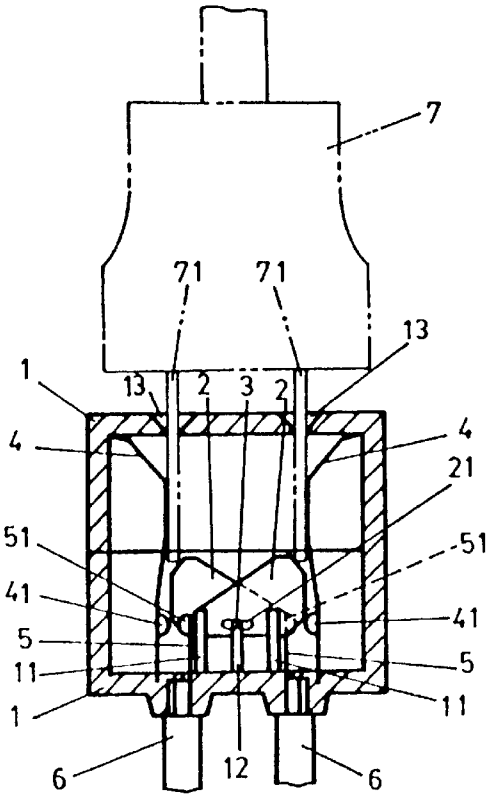
FIG. 3 is a sectional view showing that the plug is half inserted into the socket.
Figure 4:
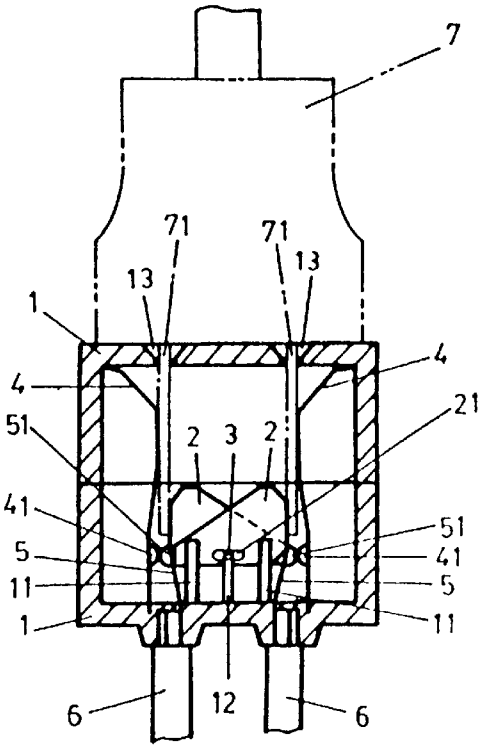
FIG. 4 is a sectional view showing that the plug is totally inserted into the socket.

Please refer to FIGS. 2 to 4. In FIG. 2, when a plug 7 is not inserted into the socket 1, the slide boards 2 are reversely pushed by the resilient force of the short leaf springs 5 away from the long leaf springs 4. At this time, the long and short leaf springs 4, 5 are separated to open the circuit. In FIGS. 3 and 4, when the plug 7 is inserted into the insertion holes 13 of the socket 1, the insertion plates 71 of the plug 7 respectively push the slide boards 2 to opposite sides, whereby the contact points 51 of the short leaf springs 5 contact with the contact points 41 of the long leaf springs 4 to close the circuit.

Figure 6:
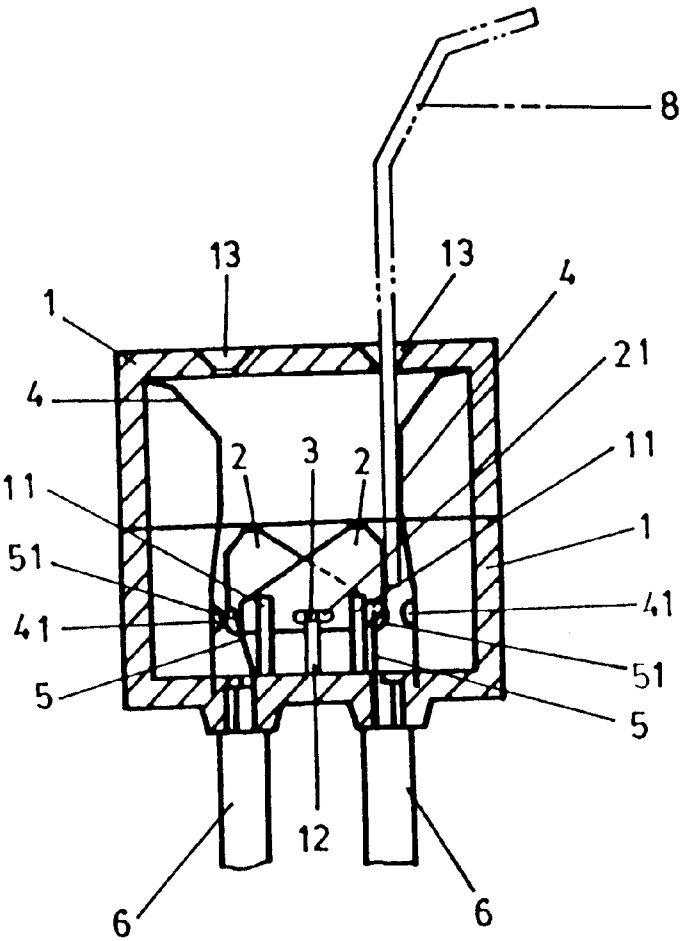
FIG. 6 shows that an alien article is inserted into the insertion hole on the other side of the socket.
Figure 5:
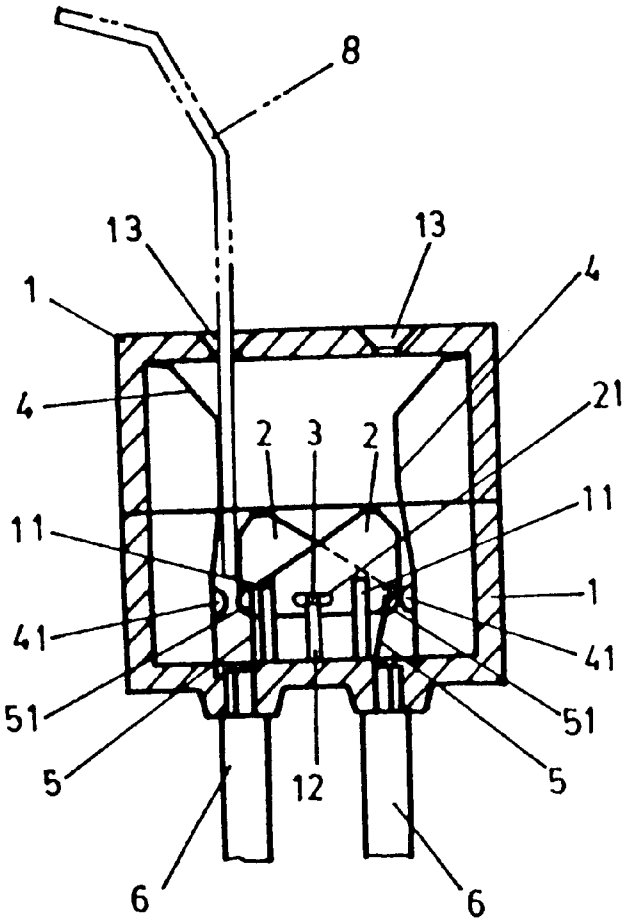
FIG. 5 shows that an alien article is inserted into the insertion hole on one side of the socket.

On the other hand, as shown in FIGS. 5 and 6, in case a conductive alien article 8 is inserted into one insertion hole 13 on one side by a child, the alien article 8 will only push the slide board 2 on one side to slide in reverse direction. Therefore, the insertion hole 13 on this side is not electrically connected with the power and no danger of shock will take place. The slide board 2 is forced and slided to make the insertion hole 13 on the other side electrically connected with the power. However, this will not affect the safety in use.

The above embodiments are applicable to 110V or 220V two hole type socket. However, with respect to the three hole type 220 V (240V ) socket, the socket can be manufactured according to the similar principle.

It is to be understood that the above description and drawings are only used for illustrating one embodiment of the present invention, not intended to limit the scope thereof. Any variation and derivation from the above description and drawings should be included in the scope of the present invention.

What is claimed is:

1. A safety socket comprising a fixing seat set composed of two high fixing seats and two low fixing seats, the high fixing seats being disposed on two sides of the low fixing seats, each high fixing seat being formed with a U-shaped recess for receiving two slide boards, the low fixing seats being disposed between the high fixing seats side by side opposite to the slide boards, a top end of each low fixing seat being formed with a semicircular notch, whereby a pin member is transversely positioned in the notch, the slide board being made of insulative material and substantially shaped as a right triangle, the slide boards being oppositely and reversely placed in the U-shaped recesses side by side, the lower edge of the slide board being disposed with an elliptic slot for the pin member to pass therethrough, whereby when the slide boards and the pin member are fixed on the high and low fixing seats, the pin member is restricted within the slots and the slide boards are limitedly left and right slidable, the socket further comprising two long and two short leaf springs which are respectively fixedly and movably inserted into two sides of the interior of the socket corresponding to the insertion holes of the socket, the short leaf springs being curved with back sides abutting against front edges of the slide boards, in a not forced state, the resilient force of the short leaf springs pushing the slide boards to the other side opposite to the long leaf springs, bottom ends of the short leaf springs being inserted and fixed in a base of the socket and being movably, stretchably and electrically connected with a power wire, the long leaf springs being fixed on inner walls of a housing of the socket, one side of each of the opposite long and short leaf springs being disposed with a convex contact point, whereby when the contact points contact with each other, the circuit is closed, the slide board in the insertion hole on one side being slidable by external force to control whether the long and short leaf springs in the insertion hole on the other side contact with each other, so that in the case that an alien article is inserted into only one insertion hole, this insertion hole is not electrically connected with the power, while the other insertion hole is electrically connected.

2. A safety socket as claimed in claim 1, wherein each angle of the slide board is cut off or formed as a round angle.

* * * * *